United States Patent [19]

Morris et al.

[11] 4,214,997

[45] Jul. 29, 1980

[54] SOIL-RELEASE COMPOSITIONS

[75] Inventors: Ronald M. Morris, Wirral; Stuart K. Pratley, Birkenhead, both of England

[73] Assignee: Lever Brothers Company, New York, N.Y.

[21] Appl. No.: 953,818

[22] Filed: Oct. 23, 1978

[30] Foreign Application Priority Data

Oct. 26, 1977 [GB] United Kingdom ..... 44580/77

[51] Int. Cl.[2] ..... C11D 3/26; D06M 15/30

[52] U.S. Cl. ..... 252/8.8; 252/8.9; 252/544; 252/547

[58] Field of Search ..... 8/137; 252/8.8, 8.9, 252/547, DIG. 2, DIG. 15

[56] References Cited

U.S. PATENT DOCUMENTS

| | | | |
|---|---|---|---|
| 3,632,420 | 1/1972 | Kuhn | 252/8.8 X |
| 3,723,358 | 3/1973 | Morgan et al. | 252/546 |
| 3,782,898 | 1/1974 | Mandell | 8/137 |
| 3,821,147 | 6/1974 | Dickson | 260/29.6 N |
| 3,836,496 | 9/1974 | Dickson | 260/29.6 H |
| 3,912,681 | 10/1975 | Dickson | 260/29.6 H |
| 4,057,503 | 11/1977 | Graver et al. | 252/8.7 |
| 4,088,610 | 5/1978 | Bevan et al. | 252/541 |
| 4,138,352 | 2/1979 | Test et al. | 252/135 |

*Primary Examiner*—P. E. Willis, Jr.
*Attorney, Agent, or Firm*—Melvin H. Kurtz

[57] ABSTRACT

A soil-release composition for the treatment of textile fabrics comprises a complex of a nonionic detergent and a polycarboxylate polymer, together with an organic quaternary ammonium surfactant compound in a concentrated aqueous solution with an acid pH.

5 Claims, No Drawings

SOIL-RELEASE COMPOSITIONS

This invention relates to soil-release compositions, to processes for preparing them, and their use in treating fabrics.

Surfaces soiled by oily hydrophobic substances can be cleaned with organic solvents, as in the dry cleaning of fabrics, but for domestic cleaning the use of an aqueous organic detergent solution is customary. Among the detergents that are commonly used are the polyoxyalkylene nonionic detergents, which have an oleophilic group that associates with the oily soil, and a polyoxyalkylene group that is hydrophilic and enables the soil to be detached, solubilised and carried away in wash water. Solid hydrophobic fatty soils such as components of sebum that have become attached to a surface are more difficult to remove with aqueous organic detergent solutions than liquid soils and in order to assist their emulsification it is necessary to use a high temperature wash.

The cleaning of fabrics with aqueous detergent solutions can be facilitated by the use of soil-release agents that are attached to the fabrics, and these may either be permanently bonded to the fabric in a finishing process or temporarily deposited on a fabric surface during the wash or in the rinse in a fabric-cleaning process. Among such soil-release agents are polycarboxylate polymers such as acrylic and methacrylic acid polymers and copolymers. These soil-release agents can be applied to the fabrics by the padding on of concentrated solutions, or by immersing the fabrics in a dilute aqueous solution under conditions favouring deposit on the fabric. Thus some polycarboxylate polymers can be applied from a dilute aqueous solution at low pH, when their water-solubility is lowered, for instance those described in U.S. Pat. No. 3,836,496: others can be made temporarily insoluble at normal rinse pH by the use of water-soluble diamines as described in U.S. Pat. No. 3,821,147; they are then removed from the fabric surface by solubilisation in a normal wash carried out under alkaline conditions.

It is known that polyalkoxyalkylene nonionic detergents form complexes with such polycarboxylate polymers under acid conditions because of the hydrogen-bonding affinity of the ether oxygen atoms of the nonionic detergents for the carboxylic acid groups. The degree of bonding of the complexes depends on pH, and under strong alkaline conditions there is complete dissociation. The water-solubility of such complexes depends upon pH and temperature, the hydrophiliclipophilic balance (HLB) of the polymer and the HLB of the nonionic detergent, the excess of nonionic detergent present and the electrolyte concentration. Proposals for the utilisation of such complexes have hitherto been limited to effluent treatment: thus Japanese Patent Publication No. 49-41282 discloses precipitation of such nonionic surfactants from effluents containing them in dilute aqueous solution by the addition of polycarboxylate polymers, and removal of the complexes by filtration, leaving a cleaner effluent.

The present invention is concerned with the use of complexes of polyoxyalkylene nonionic detergents and polycarboxylate polymers as soil-release agents having active detergent properties which are particularly effective in the removal of liquid and solid hydrophobic soils from surfaces, and which can be applied to fabrics in cold rinse water.

It has been found that by suitable choice of ingredients polyoxyalkylene nonionic detergent-polycarboxylate polymer complexes can be formulated with a substance having an insolubilising organic cation to give concentrated aqueous solutions at acid pH which on dilution with rinse water at neutral pH become less soluble and are readily taken up by fabrics to give treated fabrics with soil-release properties: on subsequent washing at alkaline pH the complexes then split to give water-soluble polycarboxylic acid anions and water-soluble nonionic detergent, both of which contribute to removal of soil in the wash. The mechanism of this action appears to be that at acid pH and relatively high concentration the complex of polycarboxylate polymer and nonionic detergent is water-soluble; on dilution with rinse water when the pH rises towards neutrality ionisation of carboxylic acid groups occurs and the resulting negative charges attract insolubilising organic cations as counter-ions so that the solubilising effect of carboxylate anions is removed and the complex is thrown out of solution; and finally in water at alkaline pH the complexes are completely split, leaving a polycarboxylate with free anions sufficient to solubilise it, and the nonionic detergent freed from the complex effects its detergent function. The removal of hydrophobic soil that has become associated with the hydrophobic portions of the complex on the treated fabric during use is thus facilitated. Such a mechanism envisages the formation in the rinse solution of an insoluble intermediate ternary complex between nonionic detergent, polycarboxylate and organic cation and its deposit on the fabric.

A soil-release composition of the invention comprises an aqueous solution of acid pH containing a dissolved complex of from 0.1 to 10% by weight of the composition of a water-soluble polycarboxylate polymer and from 0.1 to 1.2 molar equivalents of a polyoxyalkylene nonionic detergent for each carboxylic acid group of the polymer, and sufficient of an insolubilising organic cationic compound to precipitate the complex when the aqueous solution is diluted with water at 20° C. of pH in the range from 6 to 8 to a 0.005% concentration of the polymer.

By water-soluble polycarboxylate polymer is meant a polymer containing multiple carboxylic acid groups that has a solubility in water (at pH 4) at 20° C. of at least 1% by weight. In general it will have at least 20% of carboxylic acid group by weight of polymer and it preferably has at least 30% and especially at least 40%. The polymer must of course be one capable of forming complexes with polyoxyalkylene nonionic detergents under acid conditions. It can be a polymer whose units especially have the structure —$RCOXCH_2$— where R is H, methyl or ethyl, X is OH, $NH_2$ or a $C_1$ to $C_8$ alkoxy group, and where X is OH in sufficient numbers of those units to make the polymer water-soluble. It is preferably polyacrylic acid or polymetacrylic acid, or a copolymer of acrylic and/or methacrylic acid with or without a $C_1$ to $C_8$ alkyl acrylate and/or a $C_1$–$C_8$ alkyl methacrylate. The polymer can be one obtained by polymerising or copolymerising the monomers or by complete or partial hydrolysis of a corresponding $C_1$ to $C_8$ alkyl ester polymer or copolymer, or by complete or partial hydrolysis of the corresponding amide polymer or copolymer. It can have a molar weight within a wide range, for instance from 2000 to 50,000,000. Typical polycarboxylate polymers are polacrylic and polymethacrylic acids of molecular weight 230,000 and 2,000,000, the copolymers of methacrylic acid and ethyl acrylate described in US Pat. No. 3,650,801, the homopolymers of acrylic acid and methacrylic acid and the water-soluble copolymers of acrylic or methacrylic acid with alkyl esters of acrylic acid or methacrylic acid described in U.S. Pat. No. 3,782,898, and the polycarboxylate copolymers described in U.S. Pat. Nos. 3,798,169 and 3,836,496. Other polycarboxylate polymers that can be used are polymaleic acid, polyitaconic acid, methyl vinyl ether - maleic anhydride copolymers and methyl vinyl ether - acrylic acid copolymers.

Suitable polyoxyalkylene nonionic detergents are condensation products of ethylene oxide with $C_8$ to $C_{20}$ primary or secondary linear aliphatic alcohols, with $C_6$ to $C_{12}$ alkyl phenols, or with $C_8$ to $C_{20}$ primary linear aliphatic amines, and particularly those having an average of from 5 to 20 ethenoxy units per molecule. Examples of such detergents are condensates of octanol with 8 to 20 mols ethylene oxide, of dodecanol with 6,8 or 20 mols ethylene oxide, of hexadecanol with 20 mols ethylene oxide, and of octylphenol with 10 or 30 mols ethylene oxide. The polyoxyalkylene nonionic detergent will in general be one having an HLB of from 11 to 15. For ethylene oxide condensates of aliphatic alcohols the HLB can for practical purposes be calculated as the weight % of ethenoxy groups in the molecule divided by 5. The HLB of other types of nonionic detergents can be determined by methods known in the art. Preferably the nonionic detergent contains an average of from 5 to 15 ethenoxy groups. Nonionic detergents can include propenoxy units in the molecule provided the HLB of the detergent is satisfactory.

An insolubilising organic cationic compound is one whose cation reduces the solubility of polyacrylic acid. Suitable compounds having an insolubilising organic cation are quaternary ammonium salts and phosphonium salts, particularly those of the type that are well-known as cationic surfactants, especially those of the type that are relatively soluble and effective as cationic detergents, for instance cetyltrimethylammonium bromide, stearyltrimethylammonium chloride, and cetylpyridinium chloride, and also those that are water-insoluble and of the type that are well known as cationic fabric softeners, for instance distearyldimethylammonium chloride, di(coconut alkyl)dimethylammonium chloride and di(hardened tallow alkyl)dimethylammonium chloride and the corresponding acetates and methosulphates. The insolubilising organic cationic compound can be an amine with a $pK_a$ of less than 5.5, for example tallow alkyl amine. Such cationic surfactant compounds preferably have either one or two $C_{12}$ to $C_{20}$ linear alkyl groups, and these have the added advantage of conferring softening effects on fabrics when soil-release compositions of the invention incorporating them are used. Where a composition contains a cationic compound that is insoluble, it is a dispersion of the cationic compound in an aqueous solution of the complex. The water-soluble diamines utilised in the compositions of U.S. Pat. No. 3,821,147 can also be used. Mixtures of soluble and insoluble cationic compounds can be employed. Where the aqueous composition containing dissolved complex at acid pH also contains organic cationic compound in dispersion rather than in solution, it can be recognised when the complex is insolubilised on dilution of the composition with water at 20° C. and pH from 6 to 8 by observing the increase in turbidity, if necessary by using a suitable instrument.

The proportion of polycarboxylate polymer to polyoxyalkylene nonionic detergent in the complex is expressed in the requirement of from 0.1 to 1.2 molar equivalents of the nonionic detergent for each carboxylic acid group of the polymer. Preferably the proportion is such as to give from 0.4 to 0.9 molar equivalents: care should be taken to avoid such an excess of nonionic detergent that the complex is solubilised when the composition is diluted with the water to 0.005% concentration of polymer.

The amount of insolubilising organic cationic compound required to precipitate the complex when the composition is diluted with water at 20° C. and pH from 6 to 8 will depend on the specific complex employed, the excess of nonionic detergent present, and the specific organic cationic compound used, and can be determined in each instance by a process of simple testing. In general it will be such as to combine with the carboxylic acid groups of the polymer without displacing so much of the complexed nonionic detergent that the amount of this that is precipitated when the pH rises on dilution with water is seriously reduced. Where the cationic compound is soluble the amount employed will be within the range from 0.05 to 0.9 molar equivalents for each carboxylic acid group of the polymer. The amount of cationic compound required may be increased where it is present as insoluble particles. Usually the total amount of cationic organic compound will be from 1 to 6% by weight of the composition. Where a polycarboxylate polymer contaning ester groups is employed it may be necessary to allow for any slow hydrolysis which occurs under the acid pH conditions by choosing an amount of cationic compound which compensates for such hydrolysis.

The pH of a soil-release composition of the invention will in general lie within the range from 2.5 to 5.5. Care should be taken to avoid the presence of inorganic electrolytes in the compositions in quantities large enough to make the complex insoluble at acid pH. A buffer can be incorporated in the composition to ensure that on dilution with water the pH of the resulting liquor is maintained at below 8, so that when the composition is used for addition to a rinse liquor following an alkaline wash, the alkaline residues in the rinse liquor do not raise the pH above 8. Such buffer should be one that does not provide electrolyte ions sufficient to interfere with the maintenance of the complex in solution at acid pH. Other adjuvants, such as other fabric softeners, for instance the condensation product of tallow fatty acid with N(2-hydroxyethyl)-ethylenediamine (a non-cationic softener), colour and perfume can also be incorporated in a composition of the invention.

In a process of the invention a composition of the invention is prepared by forming the dissolved complex between the polycarboxylate polymer and the polyoxyalkylene nonionic detergent in aqueous solution and dispersing the organic cationic compound in the aqueous solution before or after forming the complex. The soil-release compositions can be prepared by dissolving the polycarboxylate polymer and polyoxyalkylene nonionic detergent together in water and adding the required amount of organic cationic compound, and if required, adjusting the pH of the mixture by a small amount of inorganic acid or alkali. Alternatively the polycarboxylate polymer can be added to an aqueous solution of the nonionic detergent containing the organic cationic compound in solution or dispersion: where the organic cationic compound is insoluble, it can be determined whether the polymer-nonionic detergent complex is in solution by first making the composition with the organic cationic compound added last.

In use the compositions are diluted by adding them to water at pH from 7 to 10 in amounts sufficient to give an aqueous dispersion containing from 0.001 to 0.1% of polycarboxylate polymer. The dilution can be carried out in the rinse liquor following a fabric-washing process. The invention accordingly provides an aqueous dispersion of a precipitated ternary complex containing from 0.001 to 0.1% of the polycarboxylate polymer, the polyoxyalkylene nonionic detergent and the cation of an insolubilising organic cationic compound when prepared by dilution with water of a soil-release composition of the invention, and a process for the treatment of fabrics which comprises rinsing them in such dilute aqueous dispersion and drying them.

The invention is illustrated by the following Examples in which amounts are by weight unless otherwise expressed and the temperatures are in °C.

EXAMPLE I

To a 1.47% aqueous solution of polyacrylic acid of molecular weight 230,000 (containing 62.5% of carboxylic acid group by weight of polymer, 85 parts) was added a condensate of a mixture of linear secondary $C_{11}$ to $C_{15}$ alcohols with 9 moles of ethylene oxide (of average molecular weight 579, HLB 13.7, 8 parts), the mixture stirred until the resulting gel dissolved, and the pH of the solution adjusted to 4 with N sodium hydroxide. Cetyltrimethylammonium bromide (1.5 parts) was added with stirring and when it had dissolved the composition was made up to 100 parts with demineralised water. The product was a clear colourless mobile liquid containing 1.25% polyacrylic acid, 8% polyoxyethylene nonionic detergent, and 1.5% of organic cationic compound, with 0.79 moles of nonionic detergent present for each carboxylic acid group of the polymer.

On addition of 0.4 parts of the soil-release composition to 100 parts of demineralised water at 20° and pH 7.5 in a Tergotometer there was formed a turbid dilute dispersion of ternary complex of pH 4.5. Into this was placed washed resin-finished polyester-cotton fabric (1 part) and the rinse liquor agitated at 50 rpm for 5 minutes, after which the fabric was removed, squeezed and dried. Part of the fabric was stained with dirty motor oil and another part with a model soil consisting of a mixture of tetradecanol and hexadecanol having a m.p. of 45° containing 0.1% of Sedan Red as indicator. Control fabrics were prepared in the same way but using rinse water in which none of the ternary complex was present. The fabrics stained with motor oil were washed at 50° for 10 minutes with a standard sodium dodecylbenzene sulphonate detergent, and those stained with the model soil were washed at 35° for 10 minutes with the same detergent. After washing the fabrics were rinsed and dried and their reflectance measured: from the results the detergency efficiencies % calculated were as follows.

| Fabric stained with | Control | Treated with soil-release composition |
|---|---|---|
| Motor oil | 65 | 82 |
| Model soil | 72 | 77 |

EXAMPLE 2

An aqueous dispersion containing a commercial cationic fabric softener compound was prepared having the following composition.

| | Parts |
|---|---|
| Di(hydrogenated tallow alkyl) dimethyl ammonium chloride | 2.69 |
| Mono(hydrogenated tallow alkyl)trimethylammonium chloride | 0.55 |
| Condensation product of tallow fatty acid with N(2-hydroxyethyl)ethylenediamine | 2.34 |
| Condensation product of $C_{11}$ to $C_{15}$ linear secondary alcohol mixture with | |
| 9 moles ethylene oxide | 7.42 |
| 12 moles ethylene oxide | 0.14 |
| Sodium citrate | 0.24 |
| Colour and perfume | 0.15 |
| Water | 86.47 |
| | 100 |

To this dispersion (95.6 parts) was added with stirring a 25% aqueous solution of the polyacrylic acid of Example 1 (4.4 parts), and the pH of the resulting dispersion was adjusted to 4 by addition of N aqueous sodium hydroxide solution. The resulting turbid mobile liquid contained 1.1% polyacrylic acid, 7.23% polyoxyethylene nonionic detergent (of average MW 581, HLB 13.7), and 3.1% of organic cationic compound, with 0.81 moles of nonionic detergent present for each carboxylic acid group of the polymer.

On addition of 0.4 parts of the composition to 100 parts of water at 20° and pH 7.5 there was formed a turbid dilute suspension of ternary complex of pH 4.5.

The dispersion was used to treat fabric as described in Example 1, and from the reflectance measurements obtained the detergency efficiences % calculated were as follows.

| Fabric stained with | Control | Treated with soil-release composition |
|---|---|---|
| Motor oil | 65 | 84 |
| Model soil | 72 | 75 |

EXAMPLE 3

To a 2% aqueous solution of polymethacrylic acid of molecular weight 25,000 (containing 52.3% of carboxylic acid group by weight of polymer, 75 parts) was added the ethylene oxide condensate of Example I (5 parts), the mixture stirred and cetyltrimethylammonium bromide (1.5 parts) added with further stirring until it had dissolved. The pH of the solution was adjusted to 4.9 with N aqueous sodium hydroxide and the composition made up to 100 parts with demineralised water to give a clear colourless mobile liquid containing 1.5% polymethacrylic acid, 5% polyoxyethylene nonionic detergent and 1.5% of organic cationic compound, with 0.50 moles of nonionic detergent present for each carboxylic acid group of the polymer.

The dispersion was diluted and used to treat fabric as described in Example I, and detergency efficiencies % calculated from the results were as follows.

| Fabric stained with | Control | Treated with soil-release composition |
|---|---|---|
| Motor oil | 65 | 84 |
| Model soil | 72 | 77 |

EXAMPLE 4

A composition was prepared as in Example 3, except that the polyoxyethylene nonionic detergent used was the condensation product of a $C_{11}$ to $C_{15}$ linear secondary alcohol mixture with 6 moles ethylene oxide (of average MW 447, HLB 11.8). The product was a clear colourless mobile liquid containing 1.5% polymethacrylic acid, 5% polyoxyethylene nonionic detergent and 1.5% of organic cationic compound, with 0.64 moles of nonionic detergent present for each polymer carboxylic acid group. On dilution of the composition with water of pH 7.5 at 20° to a polymer concentration of 0.005% the solution becomes turbid.

EXAMPLES 5 AND 6

Two aqueous dispersions were prepared having the following compositions.

| | Examples 5 | Examples 6 |
|---|---|---|
| | Parts | |
| Di(hydrogenated tallow alkyl)dimethylammonium chloride | 2.78 | 2.74 |
| Mono(hydrogenated tallow alkyl)dimethylammonium chloride | 0.56 | 0.55 |
| Cetyltrimethylammonium bromide | — | 1.39 |
| Condensation product of tallow fatty acid with N(2-hydroxyethyl)ethylenediamine | 2.41 | 2.38 |
| Condensation product of $C_{11}$ to $C_{15}$ linear secondary alcohol mixture with | | |
| 9 moles ethylene oxide | 4.50 | 4.50 |
| 12 moles ethylene oxide | 0.14 | 0.14 |
| Sodium citrate | 0.25 | 0.24 |
| Colour and perfume | 0.15 | 0.15 |
| Water | 89.20 | 87.91 |
| | 100 | 100 |

To each of these dispersions (93.5 parts) was added with stirring a 20% aqueous solution of the polymethacrylic acid of Example 3 (6.5 parts) and the pH of the resulting dispersion was adjusted to 4 by addition of a few drops of N aqueous sodium hydroxide solution. The resulting turbid mobile liquids contained 1.3% polymethacrylic acid, 4.34% polyoxyethylene nonionic detergent (of average MW 583, HLB 13.7), and 3.1% and 4.38% respectively of organic cationic compound, with 0.5 moles of nonionic detergent present for each polymer carboxylic acid group.

On addition of 0.4 parts of each composition to 100 parts of water at 20° and pH 7.5 there were formed turbid dilute suspensions of ternary complex of pH 4.5 and 5 respectively. These were used to treat fabric as described in Example 1, and detergency efficiencies % calculated from the results were as follows.

| Fabric stained with | Control | Treated with soil-release composition |
|---|---|---|
| Example 5 | | |
| Motor oil | 62 | 81 |
| Model soil | 66 | 71 |
| Example 6 | | |
| Motor oil | 52 | 60 |
| Model soil | 75 | 80 |

EXAMPLE 7

To an aqueous solution containing cetyltrimethylammonium bromide (1.5 parts), a condensate of coconut alkylamine with 10 moles ethylene oxide (of average MW 632, HLB 13.7, 5 parts) and demineralised water (80 parts) was added with stirring a 20% aqueous solution of the polymethacrylic acid of Exampl 3 (7.5 parts). The pH of the solution was adjusted to 4 with N aqueous sodium hydroxide solution and demineralisation water added to 100 parts to give a composition containing 1.5% polymethacrylic acid, 5% polyoxyethylene nonionic detergent and 1.5% of organic cationic compound, with 0.45 moles of nonionic detergent present for each polymer carboxylic acid group.

On addition of the composition (0.4 parts) to demineralised water (100 parts) at 20° and pH 7.5 there was formed a turbid dilute dispersion of the ternary complex of pH 5.

We claim:

1. A soil-release composition comprising an aqueous solution of acid pH containing a dissolved complex of from 0.1 to 10% by weight of the composition of a water-soluble polycarboxylate polymer having at least 40% of carboxylic acid group by weight and whose units essentially have the structure —C(R)(COX)C-$H_2$—, where R is H, methyl or ethyl, X is OH, $NH_2$ or a $C_1$ to $C_8$ alkoxy group, and where X is OH in sufficient numbers of those units to make the polymer water-soluble and from 0.1 to 1.2 molar equivalents of a polyoxyalkylene nonionic detergent having an HLB of from 11 to 15 and contains an average of from 5 to 15 ethenoxy groups for each carboxylic acid group of the polymer, and sufficient of an insolubilising organic cationic quaternary ammonium surfactant compound to precipitate the complex when the aqueous solution is diluted with water at 20° C. of pH in the range from 6 to 8 to a 0.005% concentration of the polymer.

2. A composition according to claim 1, in which the polymer is polyacrylic or polymethacrylic acid of molecular weight from 2000 to 5,000,000.

3. A composition according to claim 1, in which the polyoxyalkylene nonionic detergent is a condensation product of ethylene oxide with a $C_8$ to $C_{20}$ primary or secondary linear aliphatic alcohol, a $C_6$ to $C_{12}$ alkyl phenol, or a $C_8$ to $C_{20}$ primary linear aliphatic amine.

4. A composition according to claim 1, in which the cationic detergent is cetyltrimethylammonium bromide.

5. A composition according to claim 1, in which the cationic detergent comprises di(hydrogenated tallow alkyl)dimethylammonium chloride.

* * * * *